US010249973B2

(12) United States Patent
Frank et al.

(10) Patent No.: US 10,249,973 B2
(45) **Date of Patent: *Apr. 2, 2019**

(54) SPRING LOADED ELECTRICAL CONNECTOR

(71) Applicant: Amphenol Corporation, Wallingford, CT (US)

(72) Inventors: Ronald I. Frank, Sharon, MA (US); James R. Meszaros, Middleboro, MA (US); George L. Goulart, Jr., Dighton, MA (US); Braden J. Ishaug, Quincy, MA (US); Robert G. Hennemuth, III, Franklin, MA (US); Michael D. Smith, North Easton, MA (US); Michael A. Yashin, Cranston, RI (US); Gordon J. Udall, North Attleboro, MA (US); Daniel R. McNevin, Norton, MA (US)

(73) Assignee: Amphenol Corporation, Wallingford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/054,746

(22) Filed: Aug. 3, 2018

(65) Prior Publication Data

US 2018/0351278 A1 Dec. 6, 2018

Related U.S. Application Data

(63) Continuation of application No. 15/615,470, filed on Jun. 6, 2017, now Pat. No. 10,050,367.

(51) Int. Cl.

| | |
|---|---|
| ***H01R 13/28*** | (2006.01) |
| ***H01R 13/24*** | (2006.01) |
| *H01R 13/193* | (2006.01) |
| *H01R 24/86* | (2011.01) |
| *H01R 107/00* | (2006.01) |

(52) U.S. Cl.

CPC ..... *H01R 13/2435* (2013.01); *H01R 13/193* (2013.01); *H01R 24/86* (2013.01); *H01R 2107/00* (2013.01)

(58) Field of Classification Search

CPC ..... H01R 12/714; H01R 13/22; H01R 13/24; H01R 13/2407; H01R 13/2414; H01R 13/2421

USPC ..... 439/289, 700

See application file for complete search history.

(56) References Cited

U.S. PATENT DOCUMENTS

| | | | | |
|---|---|---|---|---|
| 3,693,133 | A * | 9/1972 | Harbonn | E21B 33/0385 439/278 |
| 5,230,632 | A | 7/1993 | Baumberger et al. | |
| 5,310,352 | A | 5/1994 | Mroczkowski | |
| 5,857,866 | A | 1/1999 | Felps | |
| 6,165,009 | A | 12/2000 | Anbo | |
| 6,248,261 | B1 | 6/2001 | Takemura et al. | |
| 6,315,576 | B1 | 11/2001 | Neidich | |
| 6,719,578 | B1 | 4/2004 | Kiassen | |

(Continued)

*Primary Examiner* — Phuong K Dinh

(74) *Attorney, Agent, or Firm* — Blank Rome LLP

(57) ABSTRACT

An electrical connector that has a housing, a contact carrier slidably coupled to the housing, at least one spring member received inside of the housing and adjacent the contact carrier for abutment with the contact carrier, and an interposer received in the receiving end of the contact carrier and remote from the spring member. The contact carrier is slidable with respect to the housing along a mating axis between unmated and mated positions.

8 Claims, 3 Drawing Sheets

(56) References Cited

U.S. PATENT DOCUMENTS

| | | | | |
|---|---|---|---|---|
| 6,908,233 | B2 | 6/2005 | Nakajima et al. | |
| 7,128,592 | B2 | 10/2006 | Li | |
| 7,517,222 | B2 | 4/2009 | Rohrbach et al. | |
| 7,946,892 | B2 | 5/2011 | Carboni et al. | |
| 8,057,241 | B2 | 11/2011 | Tamura | |
| 8,506,314 | B2 * | 8/2013 | Gramsamer ..... | H01R 13/2421 439/289 |
| 9,563,024 | B2 | 2/2017 | Zhong et al. | |
| 9,570,829 | B2 | 2/2017 | Wimmer | |
| 2014/0270645 | A1 | 9/2014 | Toth | |

* cited by examiner

SPRING LOADED ELECTRICAL CONNECTOR

RELATED APPLICATION

This application claims priority to U.S. application Ser. No. 15/615,470, entitled Spring Loaded Electrical Connector, filed on Jun. 6, 2017, the subject of which is incorporated by reference.

FIELD OF THE INVENTION

The present invention relates to an electrical connector that has a spring loaded core or contact carrier designed to ensure optimum mating force with a mating connector for consistent signal integrity.

BACKGROUND OF THE INVENTION

Conventional high density electrical connectors often have contact intermittency and mating reliability issues on the mating interface due to the tight pitch and density necessary to achieve a small package size which results in tolerance stack-up related connectivity failures. In addition, conventional high density connectors are costly to manufacture and bulky due to increased signal count. Therefore, a need exists for an electrical connector that provides a high density of contacts without increasing the size of the connector and where when mated with another connector of a connector system, provides stability and consistent signal integrity to the connector system.

SUMMARY OF THE INVENTION

Accordingly, the present invention may provide an electrical connector that comprises a housing that has a mating interface end section, an opposite cable termination end section, and an inner support member. A core is slidably coupled to the inner support member of the housing and includes a receiving end and a spring engagement end. A spring member is received inside of the housing and behind the core for abutment with the spring engagement end of the core. An interposer may be received in the receiving end of the core and remote from the spring member. The core is axially slidable with respect to the inner support member along a longitudinal axis of the housing between an unmated position, in which the spring member pushes the core outwardly away from the cable termination end of the housing, and a mated position, in which the core pushes inwardly against the spring member.

In a preferred embodiment, the electrical connector includes a contact member coupled to the core where the contact member has one end adjacent to the interposer and another end near or at the cable termination end section of the housing. The contact member may be a flexible printed circuit board that has an end face and an opposite tail end. The interposer may include at least one contact side for electrically connecting with the contact member. The interposer may be supported in the receiving end of the core by the inner support member of the housing.

In other embodiments, the at least one contact side includes a plurality of individual contacts that electrical connect with the contact member coupled to the core; the interposer includes a second contact side that is opposite to at least one contact side for electrically connecting with a mating connector; and one or more alignment pins may be provided that extend through the interposer and into the core to align the interposer with the contact member. These alignment pins may be fine alignment features that also extend through to the mating connector to ensure fine enough alignment between the connectors so that all contacts line up with the mating pad of the flex circuits. In another embodiment, the inner support member of the housing is a longitudinally extending center post and the center post has a distal free end that extends beyond the mating interface end section of the housing and through the interposer. In one embodiment, the spring member is one or more wave springs.

The present invention may also include an electrical connector that comprises a housing having a mating interface end section, an opposite cable termination end section, and an inner support member, a core is slidably coupled to the inner support member of the housing and includes a receiving end and a spring engagement end. A spring member is received inside of the housing and behind the core for abutment with the spring engagement end of the core. A first contact member is coupled to the core. A double-sided contact interposer may be received in the receiving end of the core and remote from the spring member and includes opposite first and second contact sides, the first contact side is configured to electrically connect with the first contact member and the second contact side is configured to electrically connect with a mating connector. The core is axially slidable with respect to the inner support member along a longitudinal axis of the housing between an unmated position, in which the spring member pushes the core outwardly away from the cable termination end of the housing, and a mated position, in which the core pushes inwardly against the spring member.

In one embodiment, the first contact member coupled to the core is a flexible printed circuit board that has an end face in contact with the first contact side of the double-sided contact interposer and a tail end located at or near the cable termination end section of the housing. In another embodiment, the contact member may be a conventional rigid printed circuit board. The first and second contact sides of the double-sided contact interposer may include a plurality of individual contacts. In another embodiment, the double-sided contact interposer has a wafer body supporting the plurality of individual contacts and each individual contact is a C-clip. The inner support member of the housing may be a longitudinally extending center post that has a distal free end that extends beyond the mating interface end section of the housing and through the double-sided contact interposer.

In a preferred embodiment, a mating connector is coupled to the housing when the core is in the mated position such that a second contact member of the mating connector is received in the core and electrically connects with the second side of the double-sided contact interposer and the first contact member electrically connects to the first side of the double-sided contact interposer. The second contact member may be a flexible printed circuit board having an end face that abuts the second contact side of the double-sided contact interposer. In yet another embodiment, an outer coupling member is received on the mating interface end section of the housing for coupling the mating connector to the housing. In other embodiments, the inner support member of the housing is a longitudinally extending center post where the post has a distal free end that extends beyond the mating interface end section of the housing, through the double-sided contact interposer and engages with a corresponding post of the mating connector; one or more alignment pins may extend through the first contact member, the double-sided contact interposer, and the second contact member for alignment thereof; and the spring member is one or more wave springs. In another embodiment, keyways may be provided on the connector and the mating connector which act as gross alignment features for proper alignment of the connectors.

The present invention may yet provide an electrical connector that comprises a housing that has a mating interface end section and an opposite cable termination end section and the housing has an inner support member, a contact carrier is slidably coupled to the housing, the contact carrier includes a receiving end and a spring engagement end, and the contact carrier supports at least one contact member, at least one spring member received inside of the housing and adjacent the contact carrier for abutment with the spring engagement end of the contact carrier, and an interposer is received in the receiving end of the contact carrier and remote from the spring member. The contact carrier is slidable with respect to the housing along a mating axis between unmated and mated positions.

In certain embodiments, the interposer includes at least one contact side for electrically connecting with the contact member; the at least one contact side includes a plurality of individual contacts that electrical connect with the contact member coupled to the contact carrier; and/or the interposer includes a second contact side that is opposite to the at least one contact side for electrically connecting with a mating connector. In other embodiments, one or more alignment pins that extend through the interposer and into the contact carrier to align the interposer with the contact member and/or a coupling member associated with the housing for coupling the mating connector to the housing.

The present invention may yet still provide an electrical connector that comprises a housing that has a mating interface end section and an opposite cable termination end section, a contact carrier slidably coupled to the housing, the contact carrier that includes a receiving end and a spring engagement end, and the contact carrier supports at least one contact member, at least one spring member is received inside of the housing and adjacent the contact carrier for abutment with the spring engagement end of the contact carrier, an interposer is received in the receiving end of the contact carrier and remote from the spring member, and a coupling member is associated with the housing. The contact carrier is slidable with respect to the housing along a mating axis between unmated and mated positions.

In some embodiments, the contact member is a flexible printed circuit board; the interposer has a wafer body supporting a plurality of individual contacts and each individual contact is a C-clip; and/or one or more alignment pins extending through the first contact member, the interposer, and the second contact member for alignment thereof.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawing figures.

DETAILED DESCRIPTION OF THE INVENTION

Figure 1:
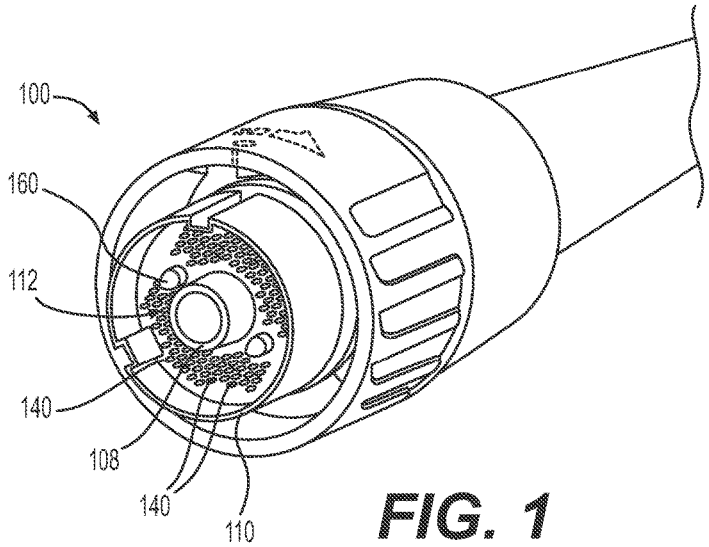
FIG. 1 is a front perspective view of an electrical connector according to an exemplary embodiment of the present invention.
Figure 2:
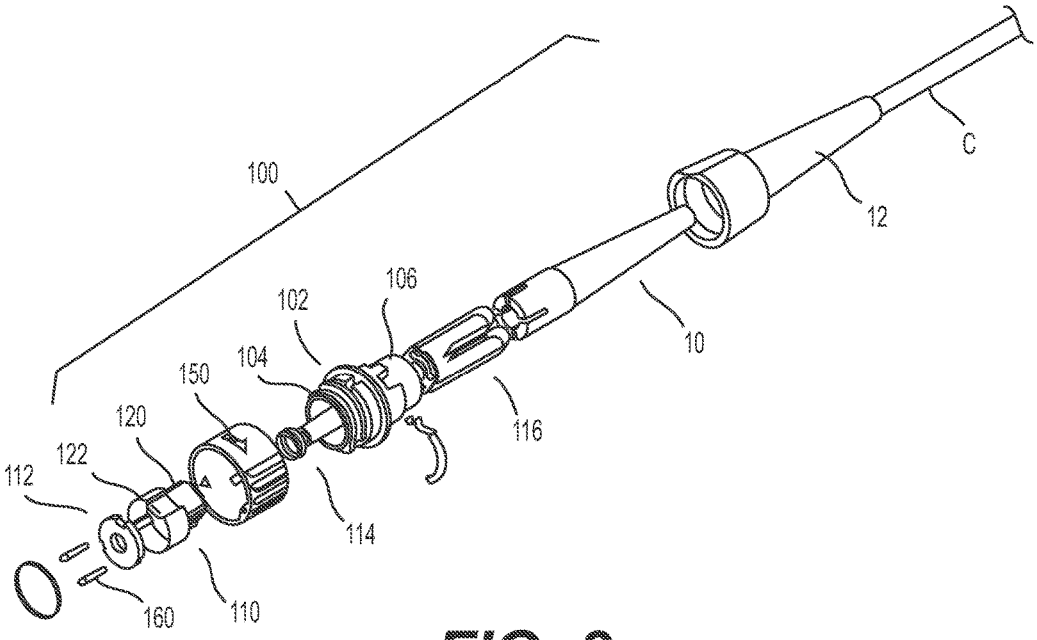
FIG. 2 is an exploded perspective view of the electrical connector illustrated in FIG. 1.

Referring to FIGS. 1-4, 5A, 5B, and 6, the present invention generally relates to an electrical connector 100, preferably a high density electrical connector, that incorporates a spring loaded core or contact carrier 110 designed to provide positive electrical contact with a mating connector 200, thereby ensuring consistent signal integrity across the connector system, that is without intermittencies before or during use of the system. Spring loaded core or contact carrier 110 is designed to allow over-travel to overcome the tolerance stack of the mated connector to ensure each of the contacts are fully engaged. Additionally, spring loaded core or contact carrier 110 maintains the electrical connection between the connectors even if their respective mating faces are non-planar to each other during mating. In a preferred embodiment, the spring loaded core or contact carrier 110 of the electrical connector 100 cooperates with a double-sided contact interposer 112 to provide the consistent electrical connection between connectors 100 and 200. Another advantage of the connector of the present invention is that it may have an increased density, such as 1 mm pitch, and may be mated/unmated up to 5,000 times. Additionally, the connector of the present invention provides an increased high density of signal contacts at low cost and that is reliable for up to 5K cycles. The design of the connector of the present invention allows users to increase the signal count while keeping the same size connector and raw cable.

In general, electrical connector 100 includes a housing 102 that slidably supports core or contact carrier 110, a spring member 114 received in housing 102 behind core 110, the interposer 112 which is received in core 110, and a contact member 116. Core or contact carrier 110 slides axially along a longitudinal axis of housing 102 between an unmated position (FIG. 3), in which core 110 is biased outwardly ready to be mated with mating connector 200, and a mated position (FIG. 4), in which core 110 is pushed inwardly and compresses spring 114 and electrically engages the mating connector. Spring member 114 may be any biasing member, such as one or more wave springs or the like.

Figure 3:
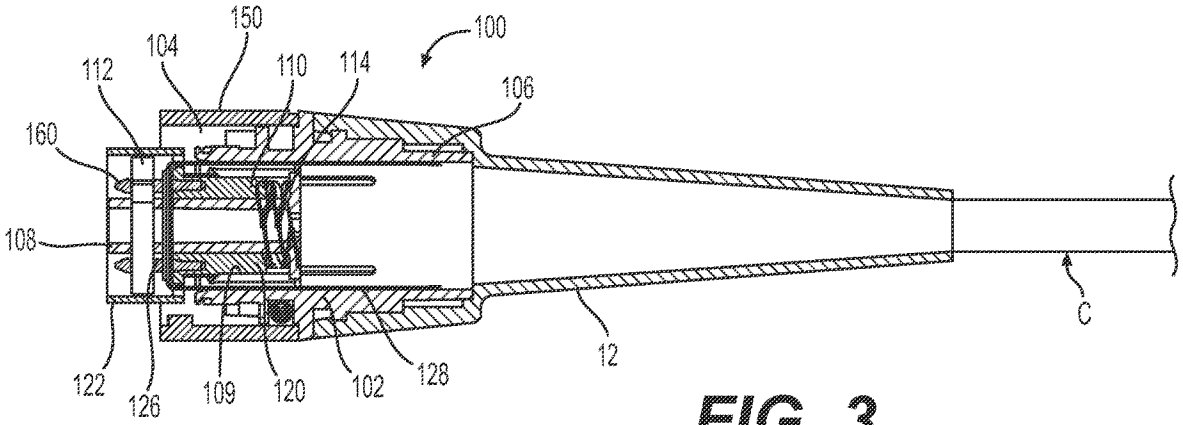
FIG. 3 is a cross-sectional view of the electrical connector illustrated in FIG. 1, showing a core or contact carrier of the electrical connector in an unmated position.
Figure 4:
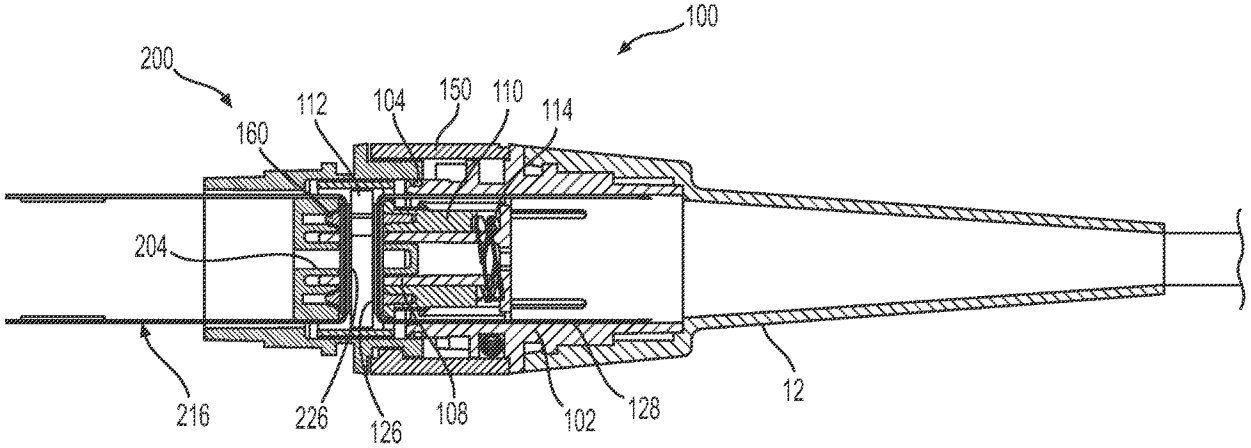
FIG. 4 is a cross-sectional of the electrical connector illustrated in FIG. 1, showing the electrical connector mated to a mating connector and showing the core or contact carrier thereof in a mated position.

Housing 102 generally includes a mating interface end section 104 for interfacing with a mating end 202 of mating connector 200, a cable termination end section 106 that receives a prepared end of a cable C, an inner support member 108 that slidably supports core 110, and an inner receiving area 109 surrounding inner support member 108 for receiving at least a portion of core 110 and receiving spring member 114 inside of housing 102. Cable termination end section 106 may also receive a potting member 10 and a strain relief member 12, such as a boot, for the prepared end of the cable C, as is well known in the art. Inner support member 108 is preferably a longitudinally extending center post or barrel, as seen in FIGS. 3 and 4. The post 108 may extend outwardly beyond mating interface end section 104 such that a distal free end thereof may engage a corresponding component 204 of mating connector 200 to provide stability to the connector system when the connectors 100 and 102 are mated, as best seen in FIG. 4. In one embodiment, post 108 is hollow at its distal end to receive corresponding component 204 of mating connector 200, which may be a post sized to be insertable into the distal end of post 108.

Core or contact carrier 110 is mounted on and slides along inner post 108 of housing 102 between its unmated and mated positions. Core 110 may also be slidably attached to the housing 102, such as by snaps and the like. Core 110 generally includes a spring engagement end 120 that abutments spring member 114 when core 110 is compressed inwardly in the mated position, and a receiving end 122 that sized and shaped to accept interposer 112. Contact member 116 is mounted in the core's spring engagement end 102 preferably such that one end is adjacent interposer 112 and its other end is near or at cable termination end section 106 of housing 102. Contact member 116 may be, for example, a flexible printed circuit board that has an end face 126 received in core 110 that is configured to electrically engage interposer 112 and a tail end 128 that connects to cable C. The tail end 128 of the flexible printed circuit board is designed to allow for bucking due to the spring loaded movement of core 110 along inner post 108 between its unmated and mated positions.

Figure 6:
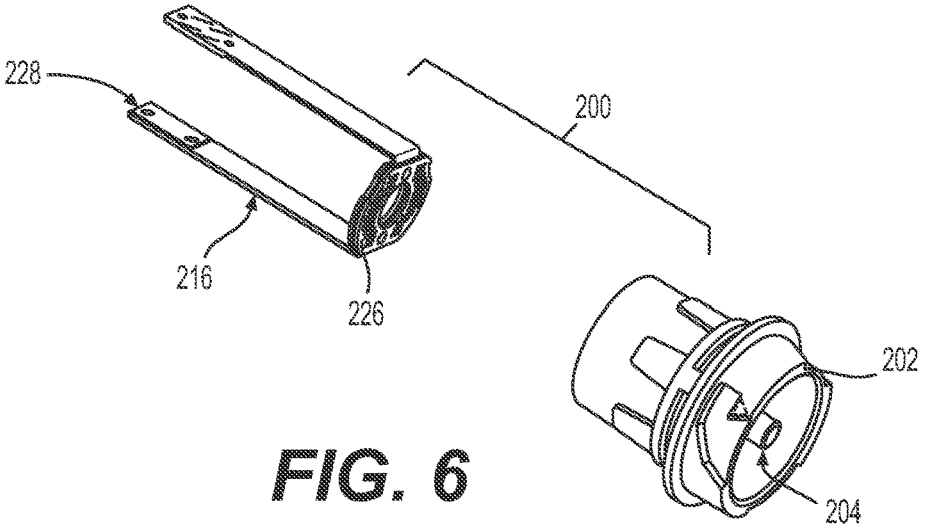
FIG. 6 is an exploded view of a mating connector that mates with the electrical connector illustrated in FIG. 1

Interposer 112 includes at least one contact side 130 for electrically contacting contact member 116, preferably at the end face 126 thereof. In a preferred embodiment, interposer 112 is a double-sided contact interposer that has a second contact side 132 that is opposite the contact side 130 and configured to electrically contact a contact member 216 of mating connector 200. Contact member 216 of mating connector 200 may also be a flexible printed circuit board with an end face 226 and tail end 228, as seen in FIG. 6, similar to contact member 116. The end face 226 is configured to abut the second contact side 132 of interposer 112.

Figure 5A:
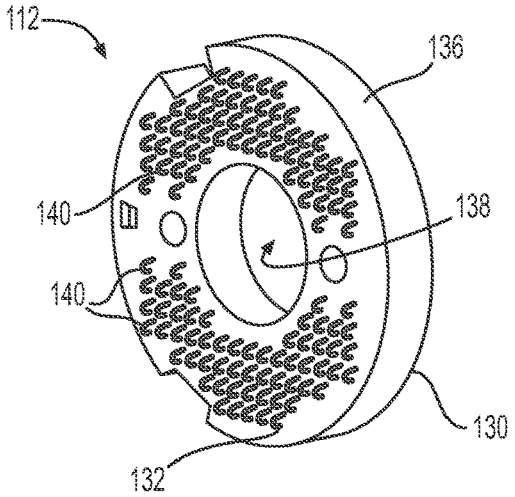
FIG. 5A is a perspective view of one side of an interposer of the electrical connector illustrated in FIG. 1.
Figure 5B:
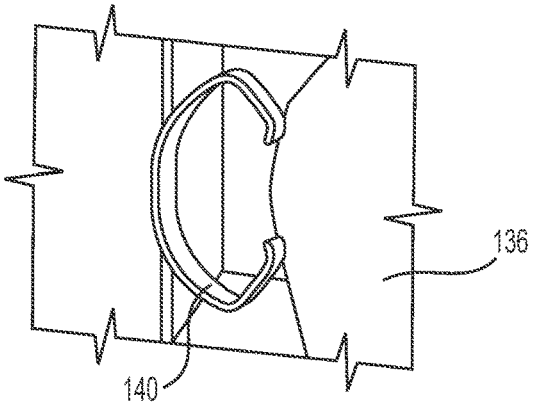
FIG. 5B is an enlarged view of an individual contact of the interposer illustrated in FIG. 5A.

In one embodiment, interposer 112 has a wafer body 136 that may include a central opening 138 sized to receive the post 108 of housing 102. Each of the contacts sides 130 and 132 of interposer 112 may include a plurality of individual contacts 140, as seen in FIG. 5A, for electrical contact with contact members 116 and 216, respectively. The individual contacts 140 may be, for example, conductive C-clips, as seen in FIG. 5B, or the like. The biasing force of spring member 114 is preferably higher than the mating force of each individual C-clip 140 loaded on interposer 112 to provide overtravel of core or contact carrier 110 beyond the full mating compression of C-clips for consistent contact with spring member 114. This ensures full compression of the contact member's end face 126 on the individual contacts 140 so that the connector system, that is the mated connectors, will have consistent mating force because that force will be dictated by the spring member 114. The mating force of the connector system may be adjusted for use of different spring members. For example, the number of individual contacts 140 of interposer 112 may be increased or decreased to increase or decrease, respectively, their biasing force where the biasing force of spring member 114 can compensate for this increase or decrease in the contacts' 140 biasing force to provide the overtravel of core or contact carrier 110. As such, the connector system can be structured to have the minimum max insertion force that can be achieved with respect to a given number of contacts.

Once the connectors 100 and 200 are mated, a coupling member 150, such as a coupling nut, may be employed to latch the connectors together. Coupling nut 150 may be designed, for example, to be spring loaded so that it autorotates and latches in place. Although the coupling nut 150 is preferably used to latch connectors 100 and 200, any know latching mechanism and/or friction fit may be used to latch or secure the connectors 100 and 200 together.

In one embodiment, the center post 108 and its corresponding component 204 of mating connector 200 generally provide the gross-alignment of the connector system, while one or more alignment members 160, such as alignment pins, generally provide fine alignment of the connector system. The one or more alignment pins 160 may extend through contact end face 226, interposer 112, contact end face 126, and into core 110 to align interposer 112, and particularly its individual contacts 140, with the end faces 126 and 226, respectively, of contact members 116 and 216 of each of the connectors 100 and 200. Alignment pins 160 may also extend through to the mating connector to ensure fine enough alignment between the connectors so that all contacts line up with the mating pad of the flex circuits.

While a particular embodiment has been chosen to illustrate the invention, it will be understood by those skilled in the art that various changes and modifications can be made therein without departing from the scope of the invention as defined in the appended claims.

What is claimed is:

1. An electrical connector, comprising:

a housing having a mating interface end section and an opposite cable termination end section and the housing having an inner support member;

a contact carrier slidably coupled to the housing, the contact carrier including a receiving end and a spring engagement end, and the contact carrier supporting at least one contact member;

at least one spring member received inside of the housing and adjacent the contact carrier for abutment with the spring engagement end of the contact carrier; and an interposer received in the receiving end of the contact carrier and remote from the spring member, the interposer including at least one contact side for electrically connecting with the contact member, wherein the contact carrier is slidable with respect to the housing along a mating axis between unmated and mated positions position.

2. The electrical connector of claim 1, wherein the at least one contact side includes a plurality of individual contacts that electrical connect with the contact member coupled to the contact carrier.

3. The electrical connector of claim 1, wherein the interposer includes a second contact side that is opposite to the at least one contact side for electrically connecting with a mating connector.

4. The electrical connector of claim 1, further comprising one or more alignment pins that extend through the interposer and into the contact carrier to align the interposer with the contact member.

5. The electrical connector of claim 1, further comprising a coupling member associated with the housing for coupling the mating connector to the housing.

6. An electrical connector, comprising:

a housing having a mating interface end section and an opposite cable termination end section;

a contact carrier slidably coupled to the housing, the contact carrier including a receiving end and a spring engagement end, and the contact carrier supporting at least one contact member, the contact member being a flexible printed circuit board;

at least one spring member received inside of the housing and adjacent the contact carrier for abutment with the spring engagement end of the contact carrier;

an interposer received in the receiving end of the contact carrier and remote from the spring member;

a coupling member associated with the housing, wherein the contact carrier is slidable with respect to the housing along a mating axis between unmated and mated positions.

7. The electrical connector of claim 6, wherein the interposer has a wafer body supporting a plurality of individual contacts and each individual contact is a C-clip.

8. The electrical connector of claim 6, wherein one or more alignment pins extending through the first contact member, the interposer, and the second contact member for alignment thereof.

* * * * *